US009718631B2

(12) United States Patent
Eguchi

(10) Patent No.: US 9,718,631 B2
(45) Date of Patent: Aug. 1, 2017

(54) SHEET CONTAINER AND IMAGE FORMING APPARATUS INCORPORATING THE SHEET CONTAINER

(71) Applicant: Yosuke Eguchi, Tokyo (JP)

(72) Inventor: Yosuke Eguchi, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/151,804

(22) Filed: May 11, 2016

(65) Prior Publication Data

US 2016/0332829 A1 Nov. 17, 2016

(30) Foreign Application Priority Data

May 14, 2015 (JP) ..... 2015-099215

(51) Int. Cl.
*B65H 1/26* (2006.01)
*B65H 1/04* (2006.01)

(52) U.S. Cl.
CPC ..... *B65H 1/04* (2013.01); *B65H 1/266* (2013.01); *B65H 2402/5155* (2013.01); *B65H 2402/64* (2013.01); *B65H 2405/113* (2013.01); *B65H 2405/114* (2013.01); *B65H 2405/121* (2013.01); *B65H 2801/06* (2013.01)

(58) Field of Classification Search
CPC ..... B65H 2405/114; B65H 2405/121; B65H 2405/113; B65H 1/04; B65H 1/266; B65H 2402/515; B65H 2402/5155; B65H 2402/64
See application file for complete search history.

(56) References Cited

U.S. PATENT DOCUMENTS

2014/0294406 A1 10/2014 Eguchi

FOREIGN PATENT DOCUMENTS

| | | |
|---|---|---|
| JP | 2004-075293 | 3/2004 |
| JP | 2006-256778 | 9/2006 |
| JP | 2009-120399 | 6/2009 |
| JP | 2010-155710 | 7/2010 |
| JP | 2014-005145 | 1/2014 |
| JP | 2014-162598 | 9/2014 |

*Primary Examiner* — Patrick Cicchino
(74) *Attorney, Agent, or Firm* — Harness, Dickey & Pierce, P.L.C.

(57) ABSTRACT

A sheet container, which is included in an image forming apparatus, includes a container body, a body side stopper device, a sheet tray, a tray side stopper device, a tray handler, a releasing device, and a tray locking device. The tray side stopper device has a tray side stopper portion to be engaged with the body side stopper device. The releasing device moves the body side stopper device along with movement of the tray handler from the first position to the second position. The releasing device cancels retention of the sheet tray in the container body and the tray locking device prevents the tray handler from canceling the retention of the sheet tray in the container body. The tray locking device regulates movement of the tray handler from the first position to the second position and moves the tray side stopper portion without moving the tray handler.

10 Claims, 10 Drawing Sheets

SHEET CONTAINER AND IMAGE FORMING APPARATUS INCORPORATING THE SHEET CONTAINER

CROSS-REFERENCE TO RELATED APPLICATIONS

This patent application is based on and claims priority pursuant to 35 U.S.C. §119(a) to Japanese Patent Application No. 2015-099215, filed on May 14, 2015, in the Japan Patent Office, the entire disclosure of which is hereby incorporated by reference herein.

BACKGROUND

Technical Field

This disclosure relates to a sheet container and an image forming apparatus incorporating the sheet container.

Related Art

Various types of image forming apparatuses includes copiers, printers, facsimile machines, or multifunction peripherals (WIN) having two or more of copying, printing, scanning, facsimile transmission, plotter, and other capabilities. Such image forming apparatuses include a sheet container having a sheet tray that is removably inserted to a container body of the sheet container and accommodates sheets therein.

For example, a known sheet container includes a hook and a cancel button. The hook engages with a pin functioning as a stopper mounted on a container body of the known sheet container. The cancel button cancels the engagement of the hook with the pin. The hook includes a hook portion at the tip. An opposed end of the hook is rotatably supported by the sheet tray. When the sheet tray is inserted in the container body, the hook-shaped portion of the hook is disposed facing the pin from an upstream side in a tray removing direction of the sheet tray. According to this configuration, when the sheet tray is pulled to remove from the container body, the hook-shaped portion contacts the pin, so that the sheet tray is retained in the container body.

The cancel button is movably held by the sheet tray. When the cancel button is pressed, the hook rotates along with movement of the cancel button, and the hook-shaped portion at the tip of the hook moves from an opposing position at which the hook-shaped portion faces the pin to a retreating position to disengage the hook from the pin. Consequently, the stopper of a drawer unit (i.e., the sheet tray) to the container body is canceled, and therefore the sheet tray can be removed from the container body.

As another example, a known sheet container includes a cylinder lock that functions as a tray locking device. The cylinder lock includes a regulating member to regulate rotation of the hook. As a user inserts a key into a key hole of the cylinder lock and turns the key, the cylinder lock is rotated to move the regulating member from the retreating position to a regulating position where rotation of the hook is restrained. Accordingly, the hook-shaped portion of the hook cannot move from the opposing position to the retreating position. As a result, cancellation of retention of the sheet tray in the container body by the cancel button is prohibited.

However, in the above-described known sheet container, it is likely that the cylinder lock is locked by mistake when the sheet tray is pulled out. In this case, the sheet tray is pushed into the container body in a state that the hook-shaped portion of the hook cannot move from the opposing position to the retreating position. Then, when the hook-shaped portion that functions as a stopper target portion at the tip of the hook contacts the pin that functions as a stopper in the container body, the sheet tray cannot be inserted further into the container body. Therefore, the sheet tray cannot be attached to the image forming apparatus. Further, if the sheet tray is further pushed into the container body with the hook-shaped portion in contact with the pin, a great load is applied to the pin and the hook, and therefore can break or damage the pin and the hook.

SUMMARY

At least one aspect of this disclosure provides a sheet container including a container body, a body side stopper device, a sheet tray, a tray side stopper device, a tray handler, a releasing device, and a tray locking device. The body side stopper device is mounted on the container body. The sheet tray is movably inserted into the container body. The tray side stopper device is movably disposed between an engaged position and a separated position and has a tray side stopper portion to be engaged with the body side stopper device. The tray handler is supported by the sheet tray to locate the sheet tray at a first position and a second position. The releasing device is rotatably supported by the sheet tray to move the body side stopper device along with movement of the tray handler from the firs-t position to the second position. The releasing device cancels retention of the sheet tray in the container body as the tray side stopper portion moves from the engaged position to the separated position. The tray locking device prevents the tray handler from canceling the retention of the sheet tray in the container body. The tray locking device regulates movement of the tray handler from the first position to the second position and allows the tray side stopper portion to move from the engaged position to the separated position without moving the tray handler.

Further, at least one aspect of this disclosure provides an image forming apparatus including the above-described sheet container to accommodate a sheet and an image forming device to form an image on the sheet fed from the sheet container.

DETAILED DESCRIPTION

Figure 1:
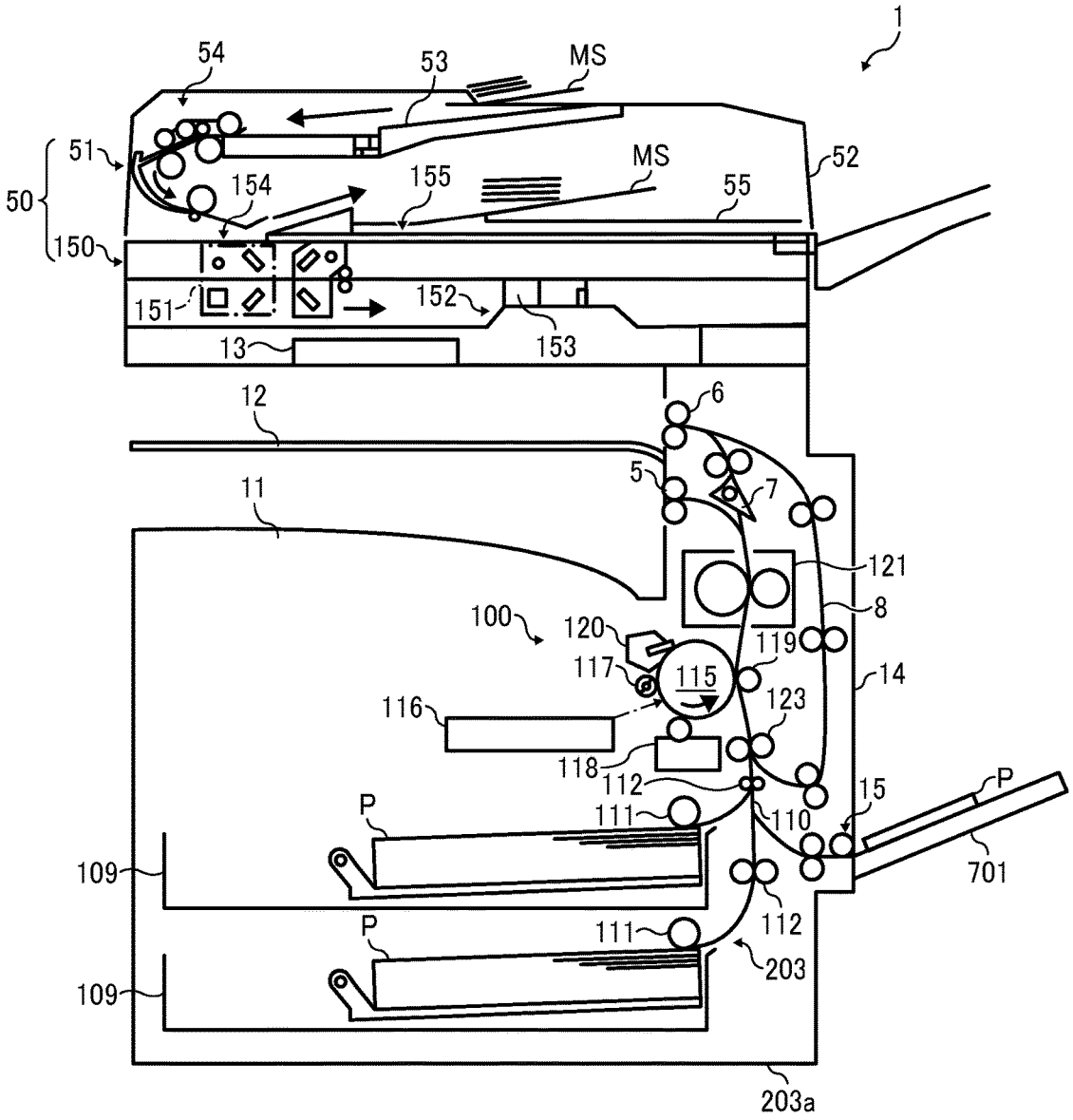
FIG. 1 is a diagram illustrating a schematic configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components,regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings,specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of an entire configuration and functions of an image forming apparatus 100 according to an embodiment of this disclosure.

FIG. 1 is a diagram illustrating a schematic configuration of an image forming apparatus 1 according to an embodiment of this disclosure.

It is to be noted that identical parts are given identical reference numerals and redundant descriptions are summarized or omitted accordingly.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

As illustrated in FIG. 1, the image forming apparatus 1 includes an image forming device 100, a sheet containing device 203, and an operation unit 13. The image forming device 100 is disposed at a substantially center of an apparatus body of the image forming apparatus 1. The sheet containing device 203 is disposed below the image forming device 100. The operation unit 13 is used by a user to cause the image forming apparatus 1 to perform image formation.

The image forming apparatus 1 further includes an image reading unit 50 that includes a scanner 150 and an automatic document feeder 51 (hereinafter, referred to as an ADF 51). The image reading unit 50 functions as an image reader. The scanner 15( )is mounted on the image forming device 100. The ADF 51 is disposed above the scanner 150 and supported by the scanner 150.

The sheet containing device 203 includes two sheet trays 109. The sheet trays 109 are detachably attached to a container body 203*a* and accommodate different types of sheets P from each other. It is to be noted that the container body 203*a* of the sheet containing device 203 basically corresponds to an apparatus body of the image forming apparatus 1.

The sheet P is fed by a sheet feed roller 111 from a selected one of the sheet trays 109 to a sheet conveying path 110 that extends from the sheet containing device 203 to the sheet output device 11 in a substantially vertical direction. The sheet P is further conveyed in the sheet conveying path 110 by a sheet conveying roller 112. After an image is formed in the image forming device 100 and is fixed to the sheet P, the sheet P is discharged to the sheet output device 11 by a pair of output rollers 5.

The image forming device 100 includes a photoconductor 115 and an optical writing device 116. The photoconductor 115 functions as an image bearer to rotate counterclockwise as indicated by arrow in FIG. 1. The optical writing device 116 forms an electrostatic latent image on a surface of the photoconductor 115.

Image forming components are disposed around the photoconductor 115. These image forming components are a charging device 117, a developing device 118, a transfer roller 119, and a cleaning device 120 and are disposed counterclockwise in this order around the photoconductor 115. The charging device 117 functions as a charger to uniformly charge the surface of the photoconductor 115.

The developing device 118 develops the electrostatic latent image formed on the surface of the photoconductor 115 by supplying toner thereon into a visible toner image. The transfer roller 119 transfers the toner image formed by the developing device 118 onto the sheet P.

The cleaning device 120 cleans the photoconductor 115 by removing residual toner remaining on the surface of the photoconductor 115 after the toner image has been transferred onto the sheet P.

The image forming apparatus 1 further includes a fixing device 121. The fixing device 121 is disposed between the transfer roller 119 and the sheet output device 11. The fixing device 121 fixes the toner image to the sheet P by application of heat and pressure.

The optical writing device 116 emits laser light to irradiate the surface of the photoconductor 115 based on image data of an original document read by the scanner 150 or image data inputted via a personal computer (PC). By optically writing the image data by the optical writing device 116, an electrostatic latent image is formed on the surface of the photoconductor 115.

The sheet P is fed by the sheet feed roller 111 selectively from one of the sheet trays 109 and is conveyed in the sheet conveying path 110.

Further, the sheet P is stopped temporarily at a pair of registration rollers 123 that is disposed upstream from the transfer roller 119 in a sheet conveying direction. When the pair of registration rollers 123 starts again, the sheet P is conveyed to a nip region formed between the transfer roller 119 and the photoconductor 115. At this time, the toner image is transferred from the photoconductor 115 onto the sheet P.

The sheet P having the toner image transferred thereto in the nip region is conveyed to the fixing device 121, where the toner image on the sheet P is fixed to the sheet P by application of heat and pressure. After this fixing operation, the sheet P is conveyed to the sheet output device 11 by the pair of sheet output rollers 5 to be output to the outside of the apparatus body of the image forming apparatus 1.

The image forming apparatus 1 according to the present embodiment can also perform duplex printing. When printing both sides of the sheet P, after the toner image is fixed to the front of the sheet P, a sheet conveying direction switching claw 7 switches the sheet conveying path to convey the sheet P toward a pair of reverse rollers 6.

After outputting the sheet P to a midway part of a sheet reversing tray 12, the pair of reverse rollers 6 reverses the sheet to convey toward a duplex sheet conveying path 8. When conveyed to the duplex sheet conveying path 8, it is determined whether the sheet P is on the front or the back, and the sheet P is conveyed to the pair of registration rollers 123 again.

After being transferred from the photoconductor 115 to the back of the sheet P that is conveyed from the pair of registration rollers 123 to the nip region, the toner image is fixed to the sheet P in the fixing device 121 and is discharged to the sheet output device 11 by the pair of sheet output rollers 5.

The image reading unit 50 that includes the scanner 150 mounted on the image forming device 100 and the ADF 51 disposed above the scanner 150 further includes two fixed reading units and a movable reading unit 152.

The movable reading unit 152 is disposed immediately below a second exposure glass 155 to move optical components such as a light source and multiple reflection mirrors in left and right directions (in a horizontal direction) in FIG. 1. The second exposure glass 155 is mounted on an upper wall of a casing of the scanner 150 so as to contact an original document MS.

In the course of moving the optical components from left to right in FIG. 1, the light source emits light. After a lower face of the original document MS placed on the second exposure glass 155 reflects the light, the reflected light is further reflected on multiple reflection mirrors until an image reading sensor 153 that is secured to the scanner 150 receives the reflected light.

The image reading unit 50 further includes a first fixed reading unit 151 and a second fixed reading unit. The first fixed reading unit 151 is disposed inside the scanner 150. The second fixed reading unit is disposed inside the ADF 51.

The first fixed reading unit 151 includes a light source, multiple reflection mirrors, and multiple image reading sensors such as charge coupled device (CCD) sensors. The first fixed reading unit 151 is disposed immediately below a first exposure glass 154 that is mounted on the upper wall of the casing of the scanner 150 so as to contact the original document MS.

When the original document MS that is conveyec by the ADF 51 passes over the first exposure glass 154, the light source emits light. After a first face of the original document MS sequentially reflects the light, the reflected light is further reflected on the multiple reflection mirrors until the image reading sensor 153 receives the reflected light.

With the above-described actions, the first face of the original document MS is scanned without moving the optical components such as the light source and the multiple reflection mirrors. The second fixed reading unit scans a second face of the original document MS after the original document MS has passed the first fixed reading unit 151.

The ADF 51 disposed on the scanner 150 includes a cover 52, an original document loading table 53, an original document conveying unit 54, and an original document stacking table 55. The original document loading table 53 is a part on which the original document MS is loaded before being scanned. The original document conveying unit 54 is a part to convey the original document MS as a sheet material The original document stacking table 55 is a part on which the original document MS is stacked after being scanned.

The image forming apparatus 1 further includes a cover 14. The cover 14 is disposed openable and closable relative to the apparatus body of the image forming apparatus 1. Specifically, in case of a paper jam in the duplex sheet conveying path 8, the cover 14 is opened to expose an inside of the duplex sheet conveying path 8. As illustrated in FIG. 1, the cover 14 includes a bypass sheet feeder 15 and a bypass tray 701 to feed more various types of sheets P.

The bypass tray 701 is openable and closable relative to the cover 14. FIG. 1 depicts the cover 14 with the bypass tray 701 open. While the bypass tray 701 is open, the sheet P is loaded on the bypass tray 701 to be fed by the bypass sheet feeder 15 toward the inside of the image forming apparatus 1.

Figure 2:
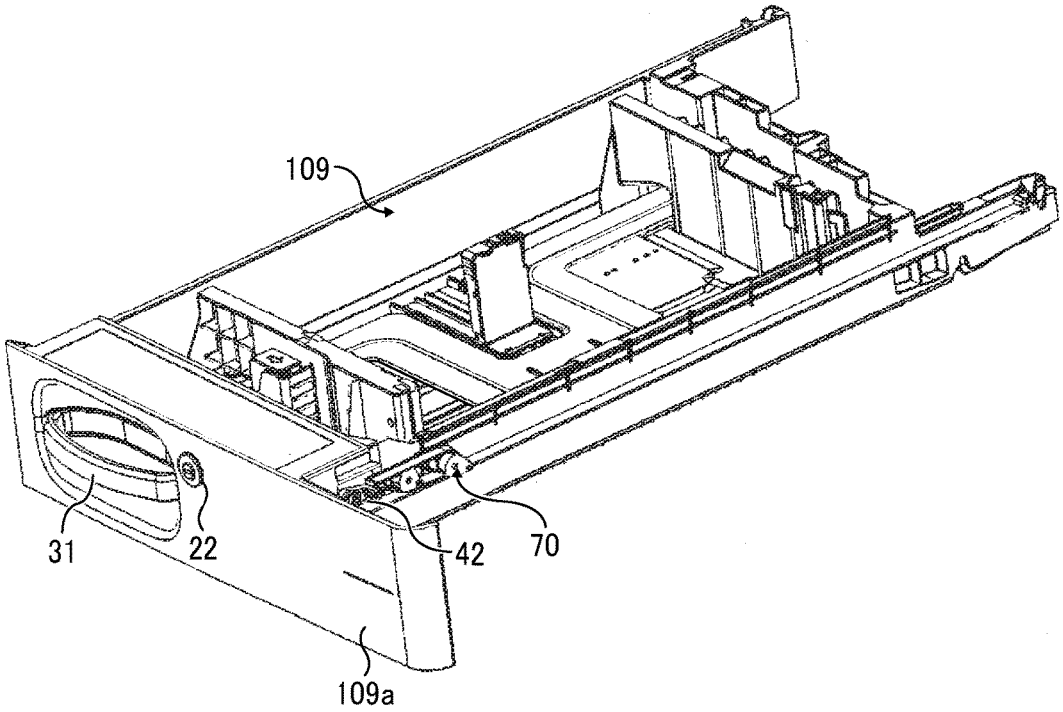
FIG. 2 is a perspective view illustrating a sheet tray included in the image forming apparatus of FIG, 1.

FIG. 2 is a perspective view illustrating the sheet tray 109.

The sheet tray 109 includes a front panel 109*a* on which a handle 31 is mounted. The sheet tray 109 further includes a stopper target member 42. The stopper target member 42 is engaged with a stopper 70 that is mounted on the container body 203*a* of the sheet containing device 203. By so doing, the sheet tray 109 is retained to the container body 203*a*. The sheet tray 109 can be pulled toward a front side of the image forming apparatus 1.

The handle 31 can be moved to the front side within a predetermined range. As described below, if the handle 31 is grasped to pull out the sheet tray 109 from the container body 203*a*, the handle 31 is moved in a tray removing direction. According to the movement of the sheet tray 109, the stopper target member 42 is moved to be removed from the stopper 70, and the sheet tray 109 is disengaged from the sheet containing body. Consequently, the sheet tray 109 can be pulled out to be removed from the container body 203*a*.

Image forming apparatuses may be used by unspecified number of people at various places, for example, on university campus. If such unspecified number of people use an image forming apparatus, sheets such as papers accommodated in the sheet tray 109 may be stolen. In the present embodiment, a cylinder lock 22 is provided to a front panel 109*a* of the sheet tray 109, so as to lock the sheet tray 109 to the container body 203*a* of the sheet containing device 203.

A key is inserted into a key hole of the cylinder lock 22 to turn the cylinder lock 22 in a state in which the sheet tray 109 is attached to the container body 203*a*. By so doing, the sheet tray 109 is locked to the image forming apparatus 1. Consequently, the sheets accommodated in the sheet tray 109 can be prevented from being stolen.

Figure 3:
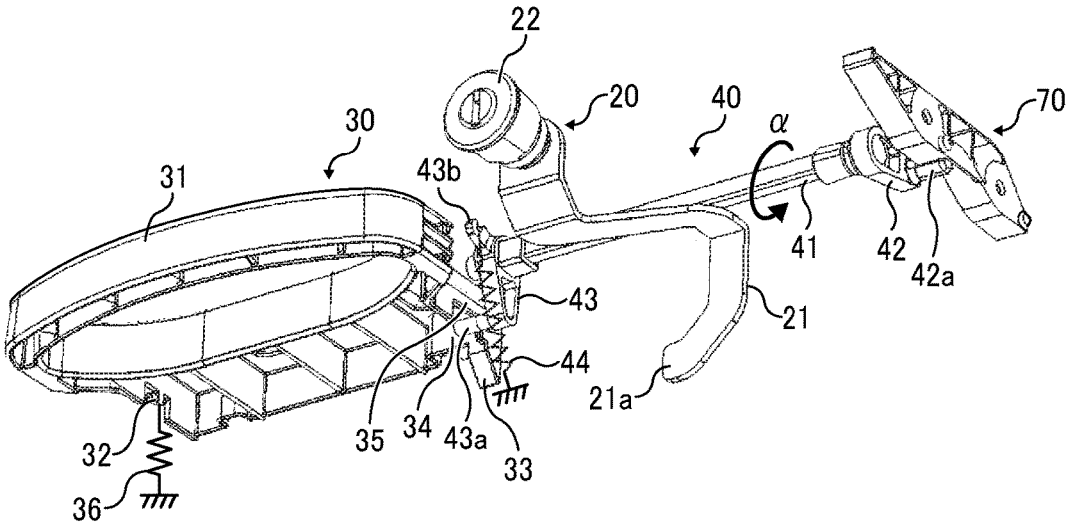
FIG. 3 is a perspective view illustrating a stopper, a tray handler, a releasing mechanism, and a locking device.

FIG. 3 is a perspective view illustrating the stopper 70, a stopper target member 42, an tray handler 30, a releasing mechanism 40, and a locking device 20. The stopper target member 42 functions as a tray side stopper device to retain the sheet tray 109 in the container body 203*a*. The releasing mechanism 40 releases retention of the sheet tray 109 in the container body 203*a* with operations performed by the tray handler 30.

The tray handler 30 includes the handle 31 and is biased by a release spring 36 toward a tray inserting direction of the sheet tray 109.

The releasing mechanism 40 is rotatably supported by the sheet tray 109 and includes a link shaft 41 and a link member 43. The stopper target member 42 is attached at one end of the link shaft 41. The releasing mechanism 40 is biased by a stopper spring 44 to rotate in a direction indicated by arrow a illustrated in FIG. 3.

The locking device 20 includes the cylinder lock 22 and a regulating member 21. As described below, the regulating member 21 having a leading portion 21*a* that is disposed facing the tray handler 30, so that the leading portion 21*a* of the regulating member 21 regulates movement of the tray handler 30 to a releasing position that functions as a second position.

Figure 4:
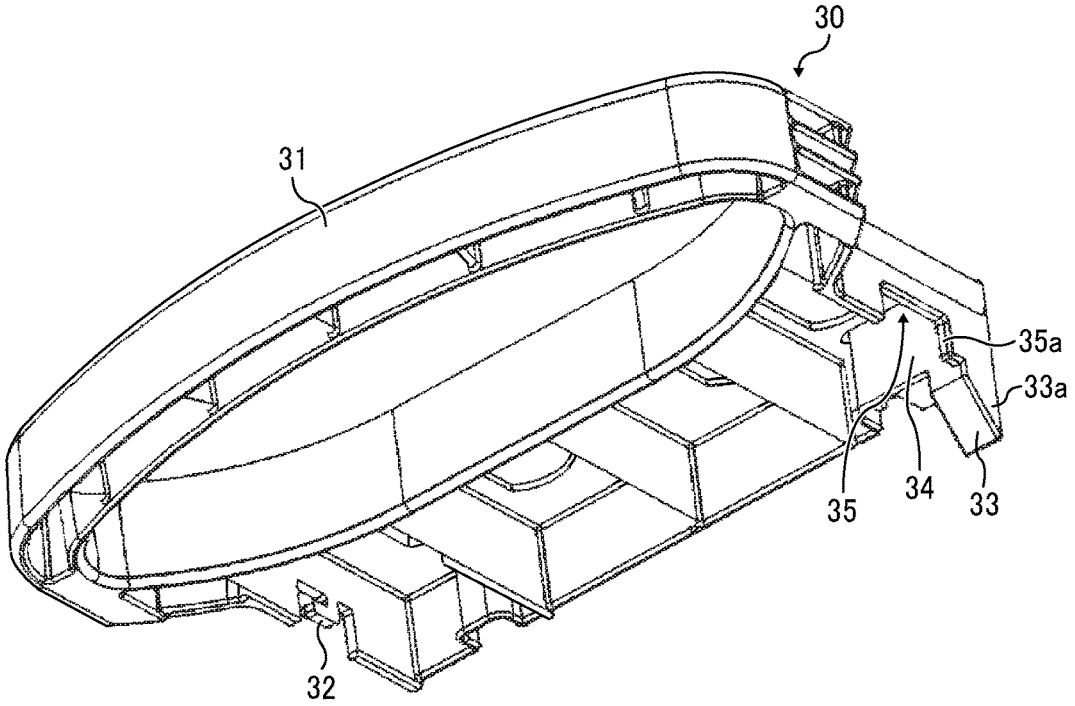
FIG. 4 is a perspective view illustrating the tray handler of FIG. 3.

FIG. 4 is a perspective view illustrating the tray handler 30.

The tray handler 30 is held by the sheet tray 109 to be movable in a tray removing direction of the sheet tray 109 in a predetermined range. The tray handler 30 includes the handle 31 as described above and a spring holder 32 to hook one end of the release spring 36. The tray handler 30 further includes a guide 33, a regulating face 34, and a movable unit 35. The guide 33 guides the regulating member 21 of the locking device 20 to a regulating position. The regulating face 34 is disposed facing the leading portion 21*a* of the regulating member 21 when the regulating member 21 is located at the regulating position, so as to regulate the movement of the regulating member 21 to the releasing position. The movable unit 35 moves the stopper target member 42 via the releasing mechanism 40.

The movable unit 35 has a cut. As illustrated in FIG. 3, a link projection 43*a* of the releasing mechanism 40 is located at the cut of the movable unit 35. A length of the movable unit 35 in the tray removing direction is set longer than a diameter of the link projection 43*a*, and therefore the link projection 43*a* can move in the cut of the movable unit 35 in a predetermined range. The guide 33 has a tapered face 33*a* that that inclines to a rear side of the image forming apparatus 1 toward a downward direction of the sheet tray 109. In other words, the width of the tapered face 33*a* gradually decreases downwardly. In the present embodiment, the guide 33 includes a flat face but the shape of the guide 33 is not limited thereto. For example, a curved face such as a concave face and a convex face can be applied as the shape of the guide 33.

Figure 5:
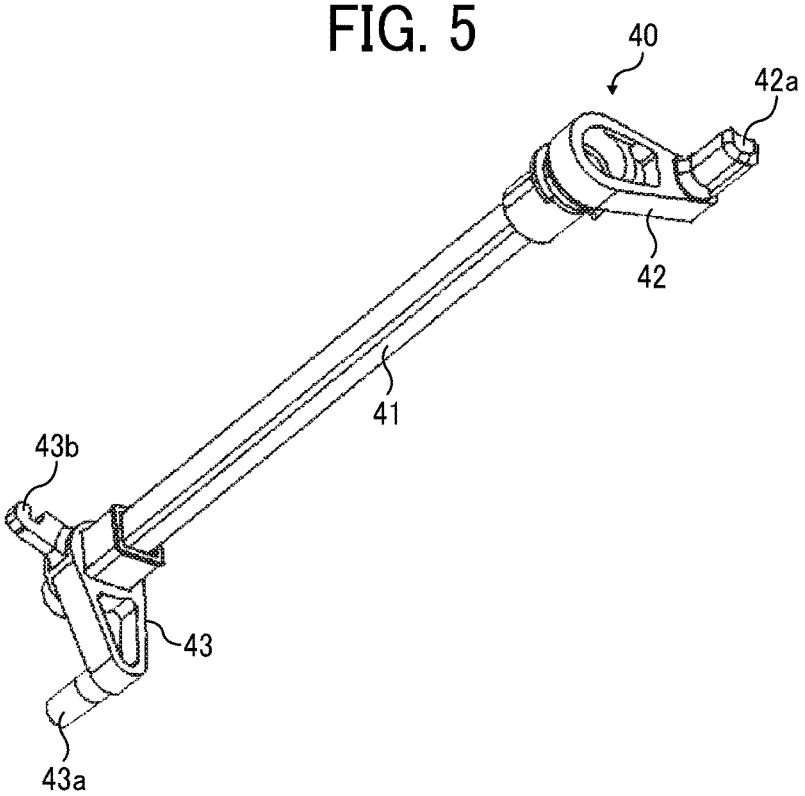
FIG. 5 is a perspective view illustrating the releasing mechanism of FIG. 3.

FIG. 5 is a perspective view illustrating the releasing mechanism 40.

The releasing mechanism 40 includes a link shaft 41 and a link member 43 and is rotatably supported by the sheet tray 109. The stopper target member 42 is attached at one end of the link shaft 41 and the link member 43 is attached to an opposed end of the link shaft 41. The stopper target member 42 that functions as a stopper target device includes a stopper target portion having a projection. The stopper target portion 42*a* is stopped by the stopper 70 that is included in the container body 203*a*.

The link member 43 includes a link projection 43*a* and a spring holder 43*b*. The link projection 43*a* has a projection. One end of the stopper spring 44 is attached to the spring holder 43*b*.

Figure 6:
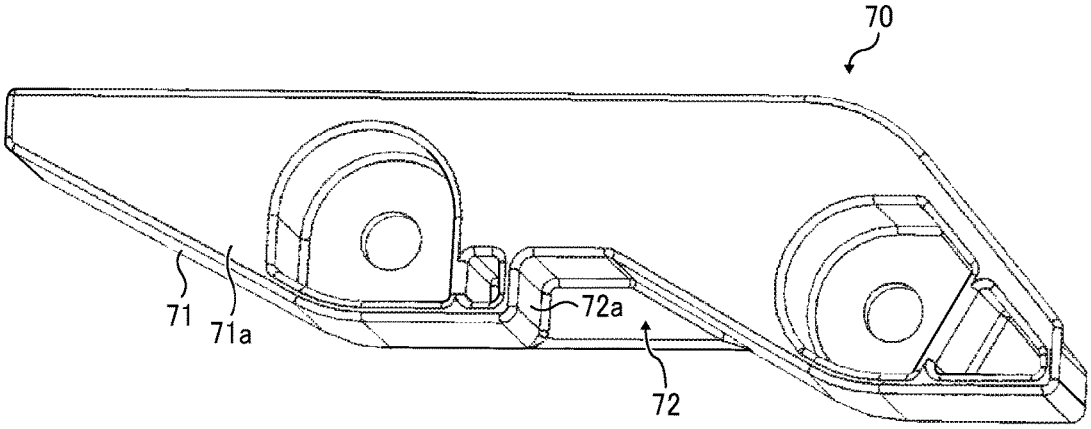
FIG. 6 is a perspective view illustrating the stopper of FIG. 3.

FIG. 6 is a perspective view illustrating the stopper 70.

The stopper 70 includes a stopper guide 71 and an opening 72. The opening 72 has a recessed portion. The stopper guide 71 guides the stopper target portion 42*a* of the releasing mechanism 40 to the opening 72. A stopping portion 72*a* is a face that extends in a vertical direction of the opening 72. The stopping portion 72*a* is disposed facing the stopper target portion 42*a* from a downstream side of the sheet tray 109 in the tray removing direction to retain the sheet tray 109 in the container body 203*a*. The stopper guide 71 has a tapered face 71*a* to incline downwardly toward the tray inserting direction of the sheet tray 109 (i.e., to the right in FIG. 6). In other words, the height of the tapered face 71*a* gradually increases downwardly toward the tray inserting direction. In the present embodiment, the stopper guide 71 includes a flat face but the shape of the stopper guide 71 is not limited thereto. For example, a curved face such as a concave face and a convex face can be applied as the shape of the stopper guide 71.

Figure 7:
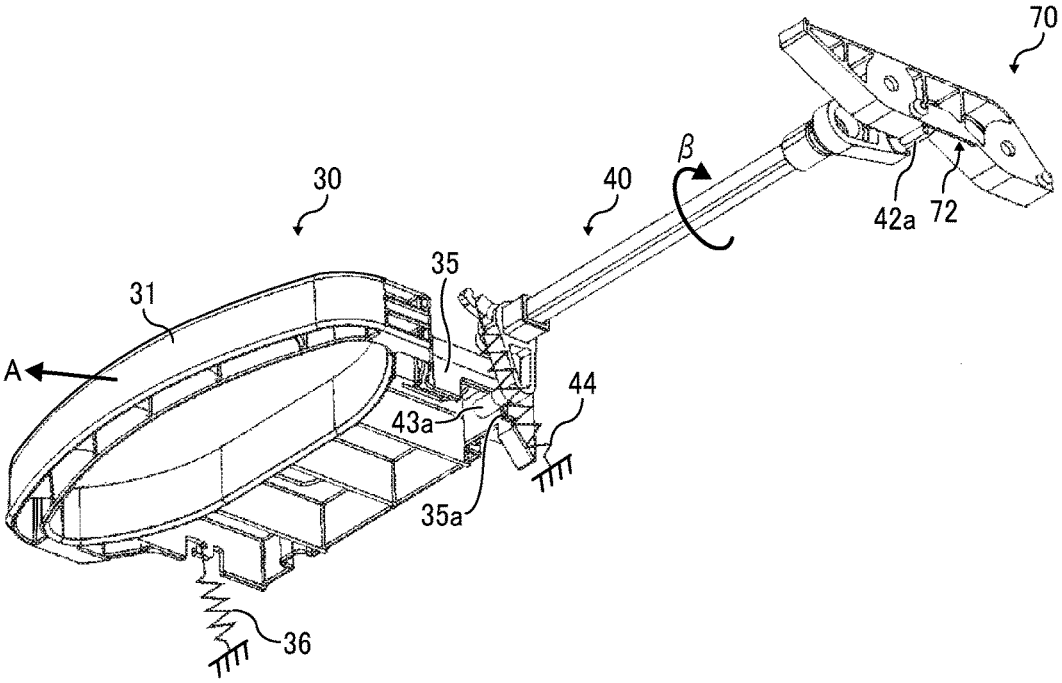
FIG. 7 is a perspective view illustrating the tray handler, the releasing mechanism, and the stopper when the sheet tray is attached to a container body of the image forming apparatus.

FIG. 7 is a perspective view illustrating the tray handler 30, the releasing mechanism 40, the stopper target member 42, and the stopper 70 when the sheet tray 109 is attached to the container body 203*a* of the sheet containing device 203.

When the sheet tray 109 is attached to the container body 203*a* of the sheet containing device 203, the stopper target portion 42*a* of the stopper target member 42 is entered in the opening 72 of the stopper 70 and is located at an engaged position at which the stopper target portion 42*a* faces the stopping portion 72*a*. According to this configuration, when the sheet tray 109 is pulled in the tray removing direction, the stopper target portion 42*a* contacts the stopping portion 72*a*. Consequently, the movement of the sheet tray 109 in the tray removing direction is regulated, and therefore the sheet tray 109 is retained in the container body 203*a*.

The releasing mechanism 40 is biased by the stopper spring 44 to rotate in a direction indicated by arrow p illustrated in FIG. 7. According to this configuration, the stopper target portion 42*a* is biased to stay the engaged position and does not come out from the opening 72 due to vibration of the image forming apparatus 1. Therefore, the stopper target portion 42*a* can be located at the engaged position reliably. Consequently, the retention of the sheet tray 109 is not released even when the image forming apparatus 1 vibrates, and therefore the sheet tray 109 can be retained in the container body 203*a*. Alternatively, the stopper target portion 42*a* can be biased by the stopper spring 44 to cause the stopper target portion 42*a* to be located at the engaged position.

Figure 8:
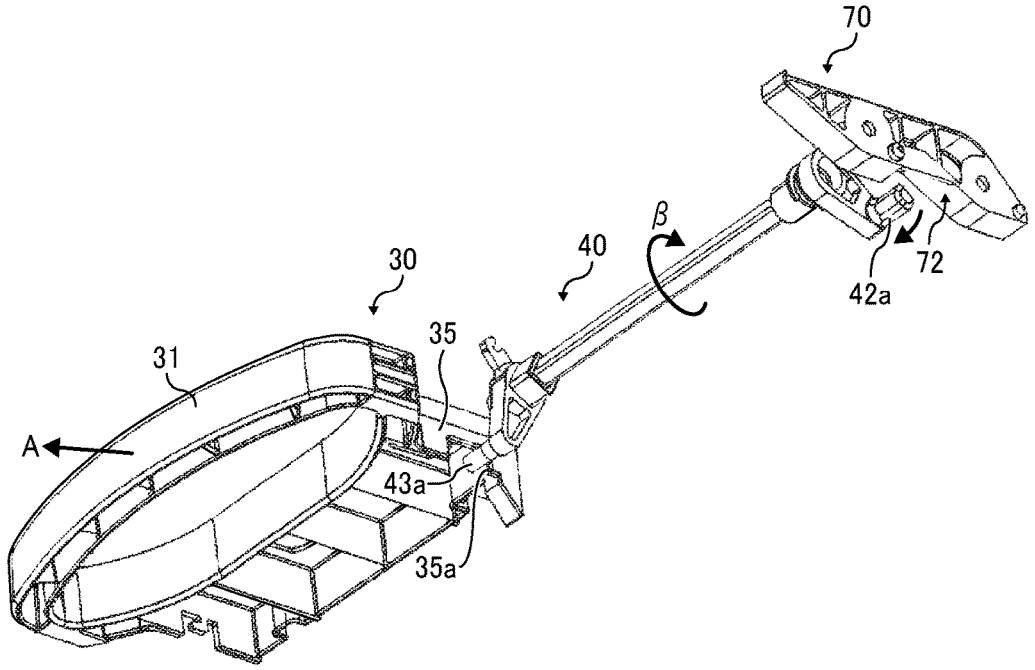
FIG. 8 is a perspective view illustrating the tray handler, the releasing mechanism, and the stopper when retention of the sheet tray in a container body.

To remove the sheet tray 109 from the container body 203*a*, a user grasps the handle 31 to pull in a direction indicated by arrow A, which is the tray removing direction. Hereinafter, the direction A is occasionally referred to as the tray removing direction A. Along with this movement of the sheet tray 109, the tray handler 30 moves from a home position to a releasing position in the direction A in FIG. 7. According to the biasing force applied by the stopper spring 44, the link projection 43*a* is in contact with an upstream end 35*a* of the movable unit 35 in the tray removing direction A. Therefore, as the tray handler 30 moves in the tray removing direction A in FIG. 7, the upstream end 35*a* of the movable unit 35 pushes the link projection 43*a* toward the tray removing direction A. Then, the releasing mechanism 40 rotates in the direction β in FIG. 7. Along with the rotation of the releasing mechanism 40, the stopper target member 42 rotates together with the releasing mechanism 40. As a result, as illustrated in FIG. 8, the stopper target portion 42*a* of the stopper target member 42 moves to the separated position that is a position where the stopper target portion 42*a* is removed from the opening 72. Accordingly, the retention of the sheet tray 109 in the container body 203*a* is canceled. When the tray handler 30 is reached to the releasing position, the tray handler 30 comes to contact the sheet tray 109. When the user pulls the handle 31 further from the above-described state, the sheet tray 109 is pressed by the tray handler 30, and therefore is removed from the container body 203*a*.

After the sheet tray 109 has been pulled out and the user has released the hand from the handle 31, the tray handler 30 moves in the tray inserting direction due to the biasing force of the release spring 36 to return to the ho, which is a first position. In addition, the releasing mechanism 40 rotates in a direction opposite the direction β in FIG. 7 (i.e., in the direction α in FIG. 3), and the stopper target member 42 rotates together with the releasing mechanism 40. Accordingly, the stopper target portion 42*a* is moved from a movable position to the engaged position.

In the present embodiment, the tray handler 30 includes the handle 31. According to this configuration, along with an action that a user holds the handle 31 to pull out the sheet tray 109 from the container body 203*a*, the tray handler 30 is moved to the releasing position. Accordingly, with one action to pull out the sheet tray 109 from the container body 203*a*, the user can cancel the retention of the sheet tray 109 in the container body 203*a* and can remove the sheet tray 109 from the container body 203*a*. Therefore, a removal operation of the sheet tray 109 can be simplified when compared with a configuration in which a user performs two actions, specifically performs one action to cancel the retention of the sheet tray 109 in the container body 203*a* and another action to remove the sheet tray 109 from the container body 203*a*. Consequently, a highly convenient image forming apparatus can be provided.

Figure 9:
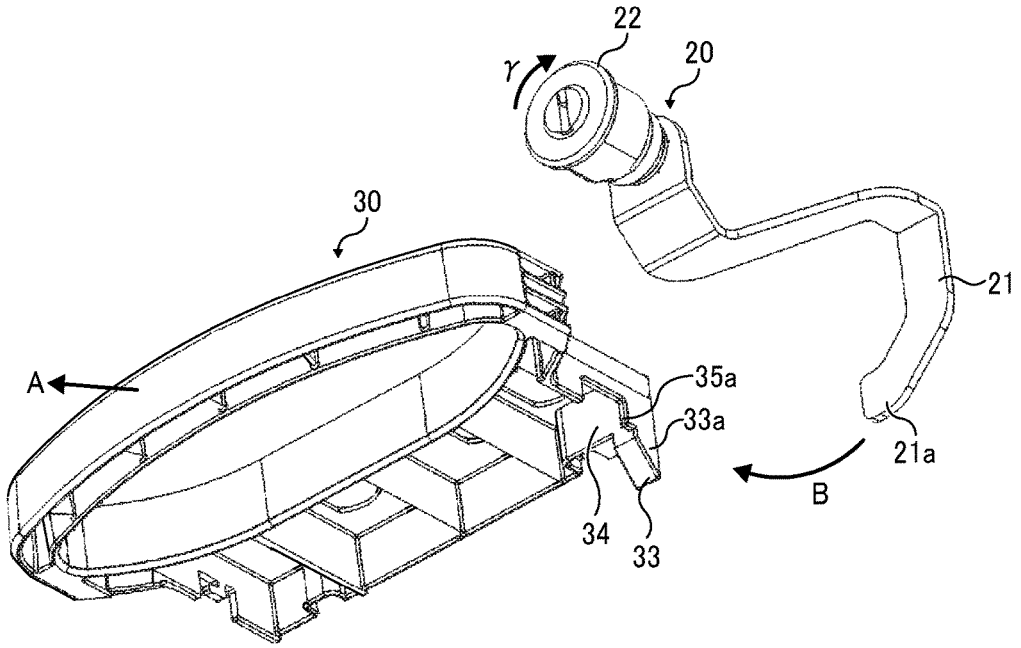
FIG. 9 is a perspective view illustrating the locking device and the tray handler when the sheet tray is unlocked.
Figure 10:
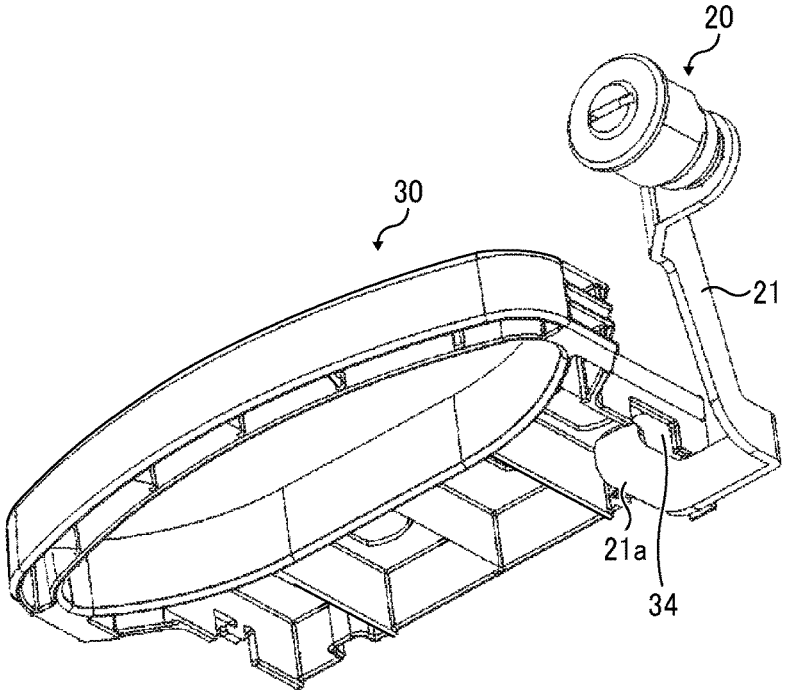
FIG. 10 is a perspective view illustrating the locking device and the tray handler when the sheet tray is locked.

FIG. 9 is a perspective view illustrating the locking device 20 and the tray handler 30 when the sheet tray 109 is unlocked. FIG. 10 is a perspective view illustrating the locking device 20 and the tray handler 30 when the sheet tray 109 is locked.

As illustrated in FIG. 9, when the sheet tray 109 is unlocked, the regulating member 21 of the locking device 20 is located at a retreating position and the tray handler 30 can move in the tray removing direction A. Consequently, when the sheet tray 109 is unlocked, the tray handler 30 can be moved from the home position to the releasing position, and therefore the retention of the sheet tray 109 to the container body 203*a* can be canceled.

When the key is inserted into the key hole of the cylinder lock 22 to rotate in a direction indicated by arrow γ of FIG. 9, the regulating member 21 rotates about the cylinder lock 22 in a direction indicated by arrow B in FIG. 9. Then, as illustrated in FIG. 10, when the key is rotated by 90 degrees, the regulating member 21 comes to the regulating position to regulate the tray handler 30. According to this action, the leading portion 21*a* of the regulating member 21 comes to face the regulating face 34 of the tray handler 30 from the downstream side of the sheet tray 109 in the tray removing direction. Accordingly, if the tray handler 30 is pulled in the tray removing direction of the sheet tray 109 so as to move the tray handler 30 to the releasing position, the regulating face 34 of the tray handler 30 comes to contact the leading portion 21*a* of the regulating member 21, thereby regulating the movement of the tray handler 30 to the releasing position. As a result, the tray handler 30 cannot rotate the releasing mechanism 40, and therefore the stopper target portion 42*a* cannot be pulled out from the opening 72. Consequently, the sheet tray 109 is not removed from the container body 203*a*, and therefore is locked to the container body 203*a* by the locking device 20.

The tray handler 30 is held by the sheet tray 109 to be movable in the tray removing direction of the sheet tray 109. According to the above-described configuration, there are clearances in the tray removing direction. For this reason, the tray handler 30 may be located at a position closer to the downstream side in the tray removing direction than the home position. In this case, it is likely that the regulating member 21 is caught by the tray handler 30, and therefore cannot rotate the regulating member 21 to the regulating position. However, in the present embodiment, the tray handler 30 includes the guide 33, as illustrated in FIG. 9. In a case in which the tray handler 30 is located at a position closer to the downstream side in the tray removing direction than the home position, the regulating member 21 contacts the guide 33. If the cylinder lock 22 is turned to rotate the regulating member 21 from the above-described state, the regulating member 21 enters the guide 33 having the tapered face 33*a*. Since the guide 33 has the tapered face 33*a*, the guide 33 receives a pressing force in an upward direction and in a direction to move the tray handler 30 to the home position. Consequently, the tray handler 30 is moved to the home position, and eventually the regulating member 21 can move to the regulating position without being caught by the tray handler 30.

Figure 11:
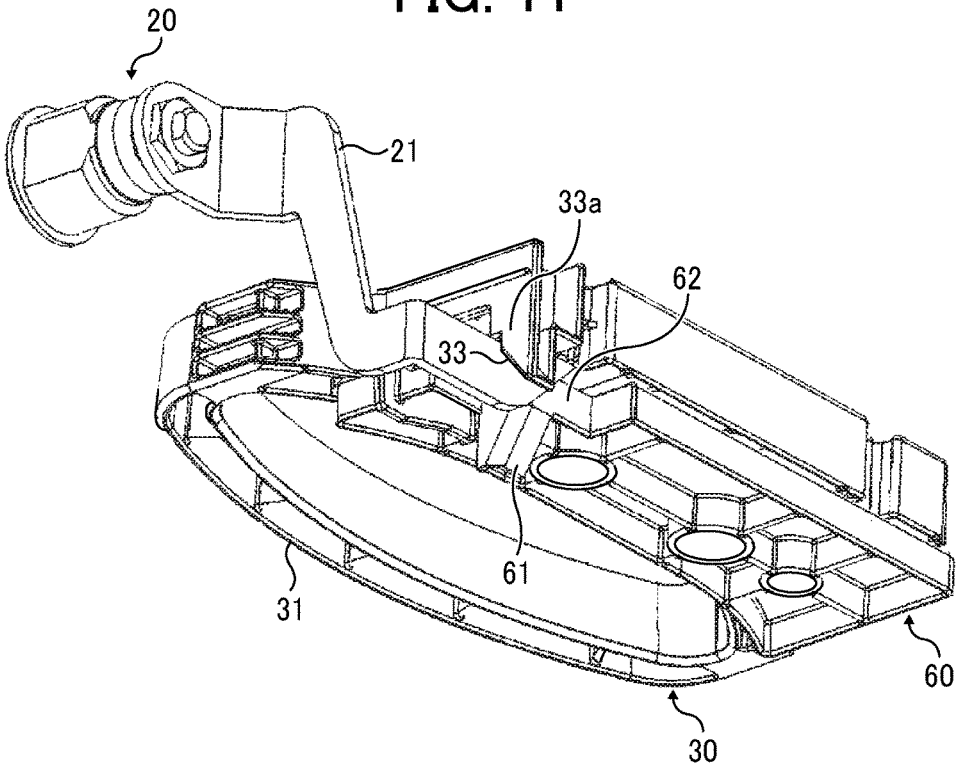
FIG. 11 is a perspective view illustrating a pressing member, the locking device, and the tray handler.

For example, when the sheet tray 109 is locked and if a user pulls the sheet tray 109 without being aware of this locking state of the sheet tray 109, the user is likely to pull out the sheet tray 109 forcedly. In this case, a large load is applied by the regulating face 34 on the leading portion 21*a* of the regulating member 21 in the tray removing direction. As a result, it is likely that the regulating member 21 is bent and deformed toward the tray removing direction of the sheet tray 109. In order to address this inconvenience, it is preferable that the image forming apparatus 1 further includes a pressing member 60, as illustrated in FIG. 11. The pressing member 60 contacts an opposite face of the regulating member 21 opposite to a contact face contacting the regulating face 34 of the tray handler 30 and presses the regulating member 21 so as not to bend and deform in the tray removing direction of the sheet tray 109.

As illustrated in FIG. 11, the pressing member 60 includes a guide 61 and a pressing face 62. The pressing face 62 contacts the opposite face and presses the regulating member 21 so as not to bend and deform in the tray removing direction of the sheet tray 109. Further, the guide 61 guides the regulating member 21 to the regulating position. The guide 61 of the pressing member 60 has a tapered face 61*a* (see FIG. 13A) to incline downwardly toward a downstream side of the tray removing direction. In other words, the width of the tapered face 61*a* gradually decreases downwardly. In the present embodiment, the guide 61 includes a flat face but the shape of the guide 61 is not limited thereto. For example, a curved face such as a concave face and a convex face can be applied as the shape of the guide 61.

Figure 12A:
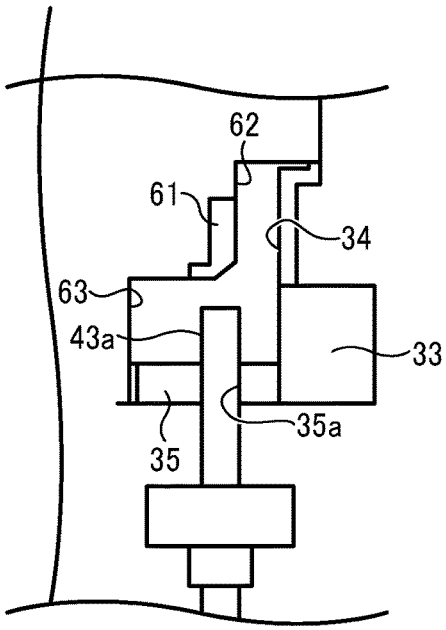
FIG. 12A is a schematic diagram illustrating an area around a guide of the pressing member, viewed from below.
Figure 12B:
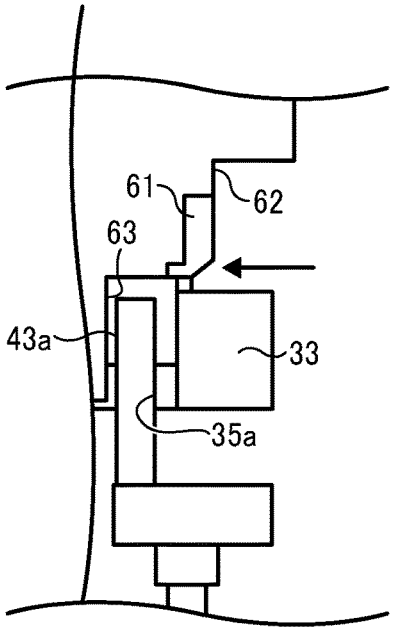
FIG. 12B is schematic diagram illustrating the area around the guide of the pressing member, viewed from below, when the guide enters a relief.

FIG. 12A is a schematic diagram illustrating an area around the guide 61 of the pressing member 60, viewed from below FIG. 12B is schematic diagram illustrating the area around the guide of the pressing member, viewed from below, when the guide enters a relief 63.

As illustrated in FIGS. 12A and 12B, the guide 61 of the pressing member 60 and the guide 33 of the tray handler 30 are located at respective positions different from each other in a direction perpendicular to the tray removing direction of the sheet tray 109. Further, the pressing member 60 further includes the relief 63 at a position facing the guide 33 of the tray handler 30. The relief 63 includes a cut.

As illustrated in FIG. 12B, when the tray handler 30 is moved to the releasing position, the guide 33 of the tray handler 30 enters the relief 63. Consequently, the guide 33 of the tray handler 30 can move the tray handler 30 to the regulating position without being caught by the pressing member 60.

Figure 13A:
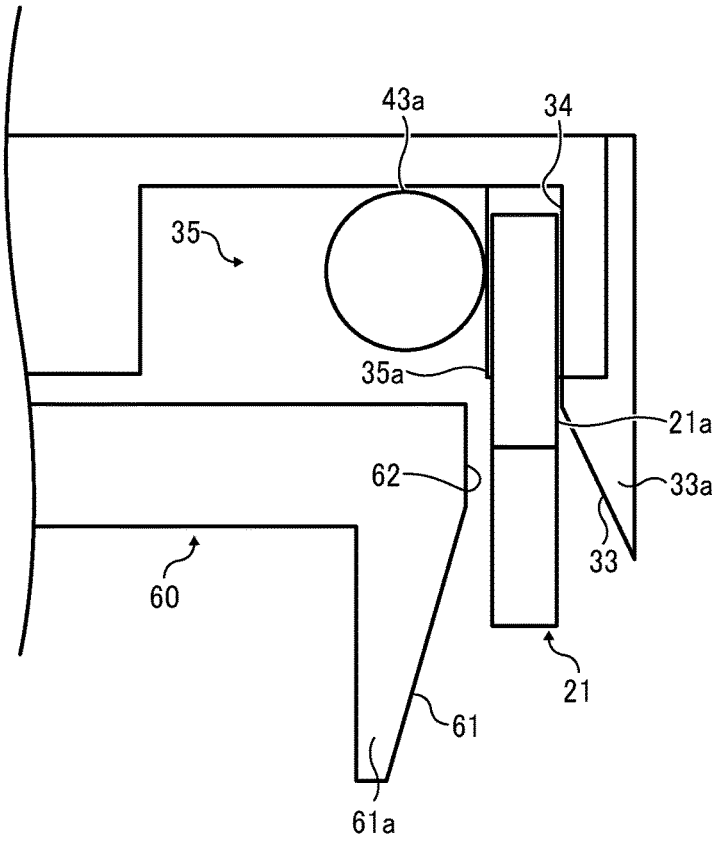
FIG. 13A is a schematic cross sectional view illustrating the area around the guide of the pressing member when the sheet tray is locked.
Figure 13B:
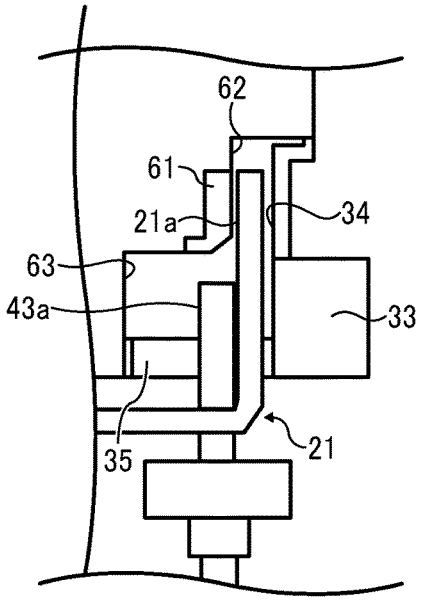
FIG. 13B is a schematic diagram illustrating the area around the guide of the pressing member when the sheet tray is locked, viewed from below.

FIG. 13A is a schematic cross sectional view illustrating the area around the guide 61 of the pressing member 60 when the sheet tray 109 is locked. FIG. 13B is a schematic diagram illustrating the area around the guide 61 of the pressing member 60 when the sheet tray 109 is locked, viewed from below.

When the sheet tray 109 is locked to the container body 203*a*, the leading portion 21*a* of the regulating member 21 enters between the pressing face 62 of the pressing member 60 and the regulating face 34 of the tray handler 30. In a state in which the sheet tray 109 is locked to the container body 203*a* of the sheet containing device 203, if the tray handler 30 is pulled to move in the tray removing direction of the sheet tray 109, the regulating face 34 comes to contact the leading portion 21*a* of the regulating member 21. When the tray handler 30 is further pulled, the leading portion 21*a* of the regulating member 21 is pressed by the regulating face 34 in the tray removing direction of the sheet tray 109. Then, the opposite face of the regulating member 21 opposite to the contact face where the leading portion 21*a* of the regulating member 21 contacts the regulating face 34 contacts the pressing face 62 of the pressing member 60. According to this action, the leading portion 21*a* of the regulating member 21 is supported by the pressing face 62, and therefore the regulating member 21 can be prevented from being bent and deformed due to a load applied by the regulating face 34.

Even in a case in which a gap between the leading portion 21*a* of the regulating member 21 and the pressing face 62 of the pressing member 60 is small and the sheet tray 109 and the front panel 109*a* of the sheet tray 109 are twisted to cause the locking device 20 to be tilted, the leading portion 21*a* of the regulating member 21 contacts the pressing member 60, and therefore it is likely that the leading portion 21*a* of the regulating member 21 cannot enter between the pressing face 62 of the pressing member 60 and the regulating face 34. However, in the present embodiment, the tray handler 30 includes the guide 33. According to this configuration, in a case in which the locking device 20 is tilted by a small degree due to twist of the sheet tray 109, the leading portion 21*a* of the regulating member 21 contacts the guide 61. Then, while the guide 61 is guiding the leading portion 21*a* of the regulating member 21, the twist of the sheet tray 109 is canceled. Accordingly, the leading portion 21*a* of the regulating member 21 can enter the gap between the pressing face 62 of the pressing member 60 and the regulating face 34 of the tray handler 30.

There is a possibility that, when the sheet tray 109 is pulled out from the container body 203*a*, the sheet tray 109 is locked by the locking device 20 by mistake. In this case, the tray handler 30 cannot move to the releasing position. However, in the present embodiment, as illustrated in FIGS. 13A and 13B, the movable unit 35 of the tray handler 30 is made longer than the diameter of the link projection 43*a* in the tray removing direction of the sheet tray 109. Therefore, the link projection 43*a* can be moved freely with respect to the movable unit 35 in the tray removing direction of the sheet tray 109. As a result, the releasing mechanism 40 is rotated by a device different from the tray handler 30 against the biasing force applied by the stopper spring 44, so as to move the stopper target portion 42*a* from the engaged position to the moving position. Accordingly, even if the tray handler 30 cannot move the stopper target portion 42*a* from the engaged position to the separated position due to the locking state of the sheet tray 109, the device different from the tray handler 30 can move the stopper target portion 42*a* from the engaged position to the separated position. By so doing, the stopper target portion 42*a* rides over the stopper 70 to enter into the opening 72. A description is given of the detailed configurations of the sheet tray 109 with reference to FIGS. 14, 15, and 16.

Figure 15:
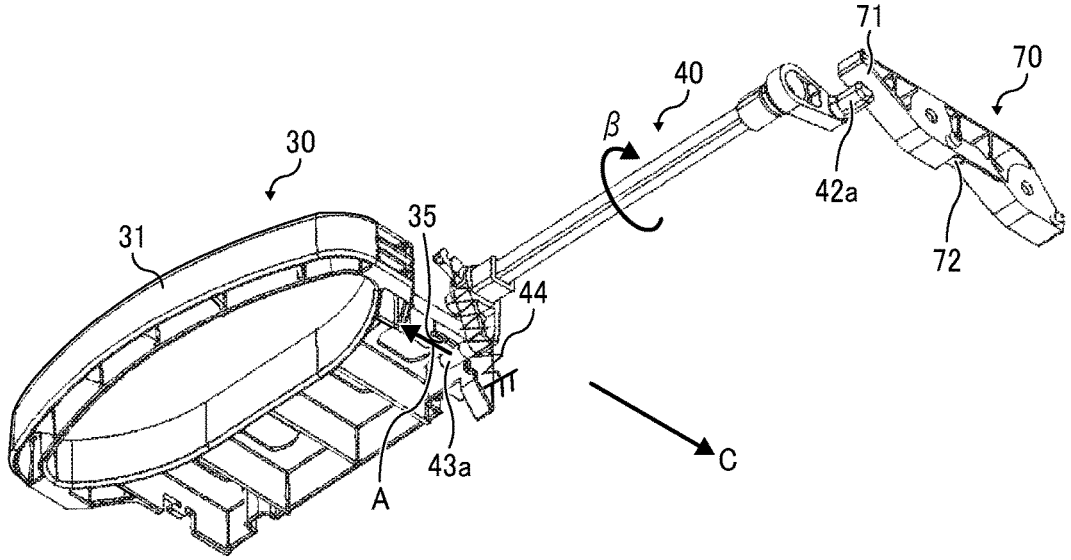
FIG. 15 is a perspective view illustrating the tray handler, the releasing mechanism, and the stopper when the sheet tray is inserted into the container body.
Figure 16:
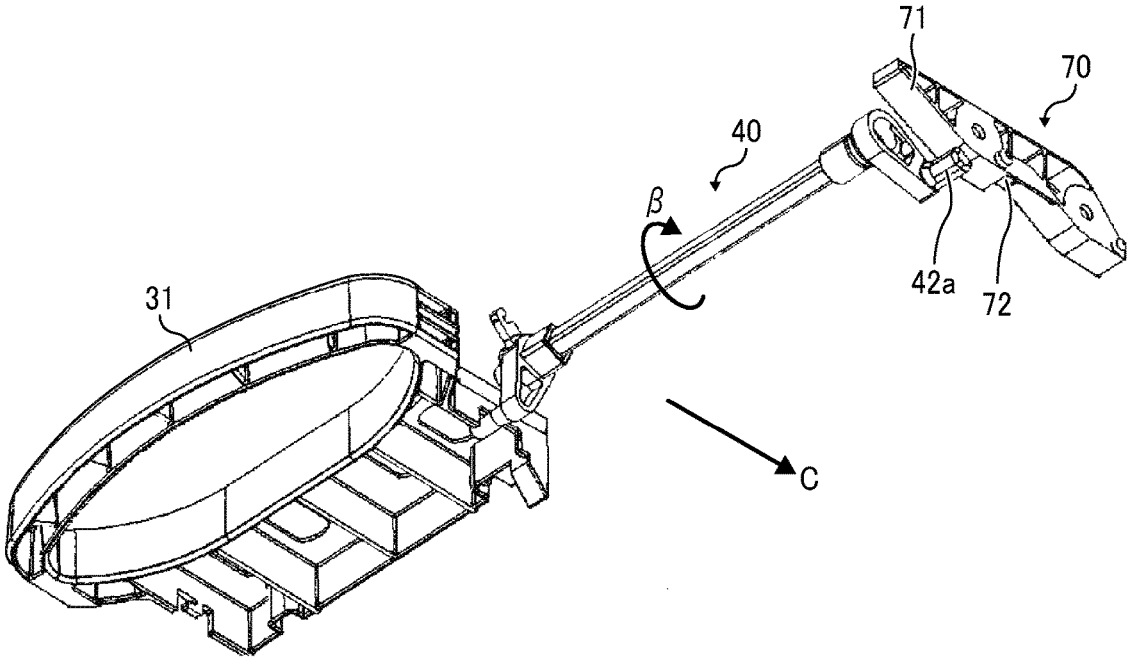
FIG. 16 is a perspective view illustrating the tray handler, the releasing mechanism, and the stopper when a stopper target portion is guided by a stopper guide.

FIG, 14 is a perspective view illustrating the sheet tray 109 when the sheet tray 109 is inserted into the container body 203*a*. FIG. 15 is a perspective view illustrating the tray handler 30, the releasing mechanism 40, the stopper target member 42, and the stopper 70 when the sheet tray 109 is inserted into the container body 203*a*. FIG. 16 is a perspective view illustrating the tray handler 30, the releasing mechanism 40, the stopper target member 42, and the stopper 70 when the stopper target portion 42*a* is guided by the stopper guide 71.

Figure 14:
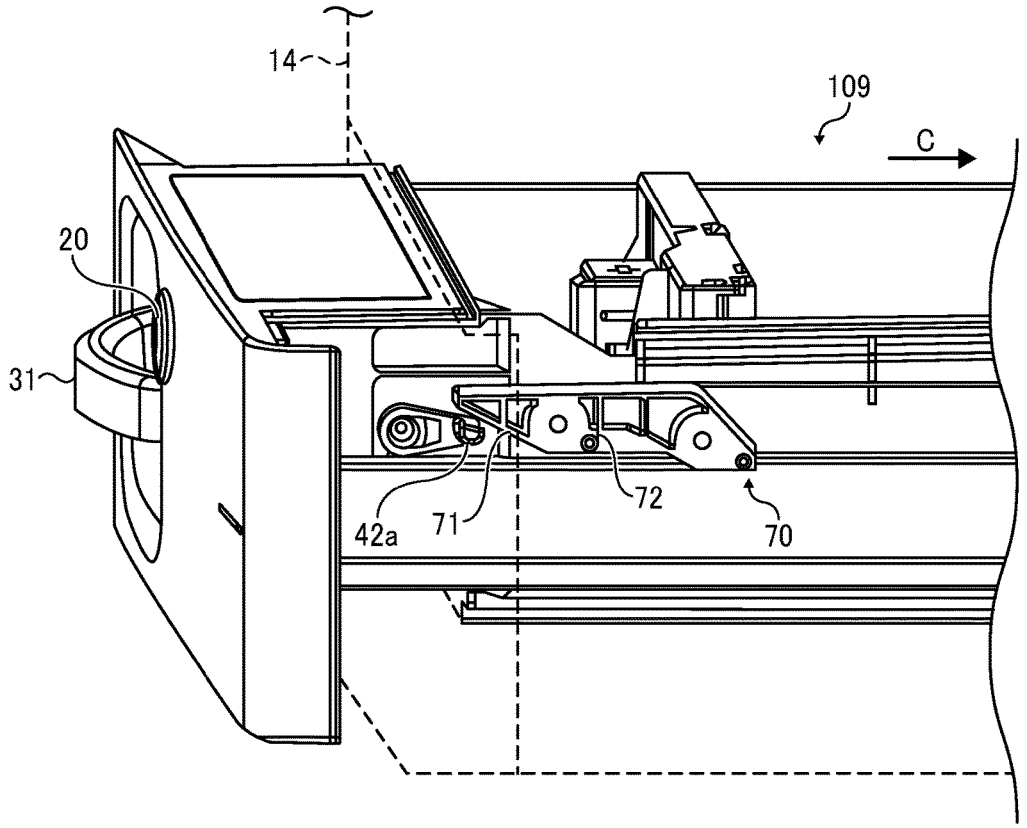
FIG. 14 is a perspective view illustrating the sheet tray when the sheet tray is inserted into the container body.

As illustrated in FIGS. 14 and 15, as the sheet tray 109 is moved in a direction indicated by arrow C to insert the sheet tray 109 into the container body 203*a*, the stopper target portion 42*a* contacts the stopper guide 71 of the stopper 70. The stopper guide 71 has the tapered face 71*a* to incline downwardly toward the tray inserting direction of the sheet tray 109 (i.e., in the direction C in FIG. 15). Specifically, the height of the tapered face 71*a* gradually increases downwardly toward the tray inserting direction. When the sheet tray 109 is further inserted with the stopper target portion 42*a* in contact with the stopper guide 71, the stopper target portion 42*a* is pressed by the stopper guide 71 downwardly.

As described above, in the present embodiment, the movable unit 35 of the tray handler 30 is set longer than the diameter of the link projection 43*a* in the tray removing direction of the sheet tray 109 and the link projection 43*a* can move with respect to the movable unit 35 in the tray removing direction of the sheet tray 109.

Therefore, as the stopper target portion 42*a* is pressed downwardly by the stopper guide 71, the releasing mechanism 40 and the stopper target member 42 rotate against the biasing force applied by the stopper spring 44. Accordingly, the link projection 43*a* is moved in the movable unit 35 in the direction indicated by arrow A (i.e., the tray removing direction of the sheet tray 109).

As the sheet tray 109 is further inserted into the container body 203*a*, the stopper target portion 42*a* rides over the stopper 70 while being guided by the stopper guide 71. Consequently, when the sheet tray 109 is attached to the container body 203*a*, the stopper target portion 42*a* reaches the opening 72. Accordingly, the releasing mechanism 40 rotates in a direction opposite the direction β FIG. 15 due to the biasing force applied by the stopper spring 44. As a result, the stopper target portion 42*a* enters into the opening 72, and therefore the sheet tray 109 is retained in the container body 203*a*.

As described above, in the present embodiment, when the sheet tray 109 is inserted into the container body 203*a*, the stopper target portion 42*a* is rotated without operating the tray handler 30, and rides over the stopper 70. Consequently, when the sheet tray 109 is inserted into the container body 203*a* of the sheet containing device 203, even if the sheet tray 109 is locked, the sheet tray 109 can be attached to the container body 203*a*. Further, even if the sheet tray 109 is locked at insertion of the sheet tray 109 into the container body 203*a*, when the stopper target portion 42*a* contacts the stopper 70, the stopper target portion 42*a* moves to release the load applied on the stopper 70 and the stopper target portion 42*a*. Therefore, the stopper target portion 42*a* and the stopper 70 are not damaged or broken, After the sheet tray 109 has been attached to the container body 203*a*, the tray handler 30 rotates the releasing mechanism 40. Consequently, by regulating the movement of the tray handler 30 by the locking device 20, the sheet tray 109 can be locked to the container body 203*a*.

Alternatively, the releasing mechanism 40 may move together with a tray handler constantly. Accordingly, the releasing mechanism 40 can move together with the tray handler as a single unit without moving the stopper target portion 42*a* of the stopper target member 42. With this configuration, even if the tray handler cannot move to the releasing position due to the locking state of the sheet tray, and the releasing mechanism cannot move accordingly, the stopper target member 42 can rotate to move from the engaged position to the separated position. Consequently, even with this configuration, the sheet tray can be attached to the container body in the locking state of the sheet tray.

Further, the stopper 70 may have a pin shape and the stopper target member 42 may have a shape illustrated in FIG. 6.

Further, the configuration in the present embodiment (i.e., the tray handler 30, the releasing mechanism 40, the stopper target member 42, the stopper 70, and the locking device 20) is not limited to a sheet tray but can be applied to a unit that is removably inserted to the container body 203*a*.

This configurations according to the above-descried embodiments are not limited thereto. This disclosure can achieve the following aspects effectively.

Aspect 1.

In Aspect 1, a sheet container (for example, the sheet containing device 203) includes a container body (for example, the container body 203*a*), a body side stopper device (for example, the stopper 70), a sheet tray (for example, the sheet tray 109), a tray side stopper device (for example, the stopper target member 42), a tray handler (for example, the tray handler 30), a releasing device (for example, the releasing mechanism 40), and a tray locking device (for example, the locking device 20). The body side stopper device is mounted on the container body. The sheet tray is removably inserted into the container body. The tray side stopper device is movably disposed between an engaged position and a separated position and has a tray side stopper portion (for example, the stopper target portion 42*a*) to be engaged with the body side stopper device. The tray handler is supported by the sheet tray to locate the sheet tray at a first position (for example, the home position and a second position (for example, the releasing position). The releasing device is rotatably supported by the sheet tray to move the body side stopper device along with movement of the tray handler from the first position to the second position. The releasing device cancels retention of the sheet tray in the container body as the tray side stopper portion moves from the engaged position to the separated position. The tray locking device prevents the tray handler from canceling the retention of the sheet tray in the container body. The tray locking device regulates movement of the tray handler from the first position to the second position and allowing the tray side stopper portion to move from the engaged position to the separated position without moving the tray handler.

According to this configuration, since the tray locking device regulates the movement of the tray handler to move from the first position to the second position, the sheet tray cannot be removed from the container body due to the movement of the tray handler.

Further, a tapered face that inclines to a tray inserting direction of the sheet tray toward the container body is generally provided on one of the body side stopper device and the tray side stopper portion of the tray side stopper device. After the tray side stopper portion of the tray side stopper device has contacted the body side stopper device, as the sheet tray is further inserted into the container body, the tray side stopper portion moves form the engaged position to the separated position along the tapered face, so that the tray side stopper portion rides over the body side stopper device.

In Aspect 1, the tray side stopper portion of the tray side stopper device can move from the engaged position to the separated position without moving the tray handler. Therefore, even if the tray handler cannot move due to the regulation of movement performed by the tray locking device, the tray side stopper device can move from the engaged position to the separated position. Accordingly, after the sheet tray has been inserted into the container body in a state in which the tray locking device regulates the movement of the tray handler and the tray side stopper device has contacted the body side stopper device, the tray side stopper portion moves by riding over the body side stopper device. By so doing, the sheet tray can be attached to the container body of the sheet container. Further, after the tray side stopper portion has contacted the body side stopper device, the body side stopper device moves to release the load applied on the body side stopper device and the tray side stopper portion of the tray side stopper device. Consequently, the body side stopper device and the tray side stopper portion of the tray side stopper device are prevented from being damaged or broken.

Aspect 2.

In Aspect 1, the tray handler (for example, the tray handler 30) includes a handle (for example, the handle 31) mounted on the sheet tray (for example, the sheet tray 109) to grasp when the sheet tray is removed from the container body (for example, the container body 203*a*).

According to this configuration, as the sheet tray is pulled out from the container body, retention of the sheet tray to the container body is canceled. Accordingly, with one action to pull out the sheet tray from the container body, a user can cancel the retention of the sheet tray to the container body and can remove sheet tray from the container body. As a result, when compared to a comparative sheet containing device having a configuration in which a cancel button is pressed to cancel engagement of the sheet tray to the container body and the sheet tray is removed from the container body, the configuration according to the present embodiment of this disclosure can remove the sheet tray more simply.

Aspect 3.

In Aspect 1 or Aspect 2, the tray locking device (for example, the tray locking device 20) includes a cylinder lock (for example, the cylinder lock 22) and a regulating unit (for example, the regulating member 21) to regulate the movement of the tray handler from the first position to the second position. The cylinder lock turns to move the regulating unit between a regulating position at which the movement of the tray handler is regulated and a retreating position at which the regulating unit is retreated from the tray handler.

According to this configuration, as described in the above-described embodiments, the sheet tray can be locked to the sheet container.

Aspect 4.

In Aspect 3, the tray handler (for example, the tray handler 30) includes a guide (for example, the guide 33) to guide the regulating unit (for example, the regulating member 21) to the regulating position.

According to this configuration, as described in the embodiments above, even if the tray handler has not yet fully returned to the first position (for example, the home position), the regulating unit is guided to the guide so as to move the regulating unit to the regulating position.

Aspect 5.

In Aspect 3 or Aspect 4, the sheet container (for example, the sheet containing device 203) further includes a pressing unit (for example, the pressing member 60) disposed near the tray handler to contact and regulate the tray handler to move to the second position when the regulating unit is located at the regulating position. The pressing unit presses a face of the regulating unit (for example, the regulating member 21) opposite a contact face with the tray handler (for example, the tray handler 30) and preventing the regulating unit from bending toward the second position (for example, the releasing position).

According to this configuration, as described in the above-described embodiments, the regulating unit can be prevented from being bent or deformed.

Aspect 6.

In Aspect 5, the pressing unit includes a guide (for example, the guide 61) to guide the regulating unit (for example, the regulating member 21) to the regulating position.

According to this configuration, as described in the above-described embodiments, even if the sheet tray is twisted and the tray locking device (for example, the locking device 20) is inclined, the guide of the pressing unit (for example, the pressing member 60) guides the regulating unit to the regulating position.

Aspect 7.

In any one of Aspect 1 through Aspect 6, the sheet container (for example, the sheet containing device 203) further includes a biasing unit (for example, the release spring 36) to bias the tray handler (for example, the tray handler 30) in a direction opposite a moving direction of the tray handler toward the second position (for example, the releasing position).

According to this configuration, as described in the above-described embodiments, the tray handler can be moved from the second position to the first position (for example, the home position) by the biasing force applied by the biasing unit.

Aspect 8.

In any one of Aspect 1 through Aspect 7, the sheet container (for example, the sheet containing device 203) further includes a biasing unit (for example, the stopper spring 44) to bias the tray side stopper device such that the tray side stopper portion is located at the engaged position.

According to this configuration, as described in the embodiments above, the tray side stopper portion (for example, the stopper target portion 42*a*) is prevented from moving from the engaged position due to vibration of the image forming apparatus (for example, the image forming apparatus 1). Therefore, the sheet tray (for example, the sheet tray 109) can be prevented from being separated from the container body by cancellation of the retention in the container body due to vibration of the image forming apparatus.

Aspect 9.

In any one of Aspect 1 through Aspect 8, the sheet container (for example, the sheet containing device 203) further includes a stopper guide (for example, the stopper guide 71) to guide the tray side stopper portion (for example, the stopper target portion 42*a*) such that the tray stopper portion rides over the body side stopper device (for example, the stopper 70) when the sheet tray (for example, the sheet tray 109) is inserted into the container body (for example, the container body 203*a*).

According to this configuration, as described in the embodiments above, even when the tray handler (for example, the tray handler 30) is locked by the tray locking device (for example, the locking device 20), the tray side stopper portion is guided by the stopper guide. Therefore, the tray side stopper device (for example, the stopper target member 42) moves individually without moving the tray handler, and the tray side stopper portion rides over the body side stopper device (for example, the stopper 70). Consequently, if the sheet tray is inserted into the container body while the tray locking device is locking the sheet tray, the sheet tray can be attached reliably.

Aspect 10.

An image forming apparatus (for example, the image forming apparatus 1) includes the sheet container (for example, the sheet containing device 203) to accommodate a sheet, and an image forming device (for example, the image forming device 100) to form an image on the sheet fed from the sheet container. The image forming apparatus includes the sheet container according to any one of Aspect 1 through Aspect 9.

According to this configuration, as described in the above-described examples, even if the tray locking device (for example, the locking device 20) locks the sheet tray (for example, the sheet tray 109) by mistake when the sheet tray is removed from the container body, the sheet tray can be attached to the container body (for example, the container body 203*a*).

According to this configuration, as described in the above-described embodiments, The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet container comprising:

a container body;

a body side stopper device mounted on the container body;

a sheet tray removably inserted into the container body;

a tray side stopper device movably disposed between an engaged position and a separated position and having a tray side stopper portion to be engaged with the body side stopper device;

a tray handler supported by the sheet tray to locate the sheet tray at a first position and a second position;

a releasing device rotatably supported by the sheet tray to move the body side stopper device along with movement of the tray handler from the first position to the second position, the releasing device to cancel retention of the sheet tray in the container body as the tray side stopper portion moves from the engaged position to the separated position; and a tray locking device to prevent the tray handler from canceling the retention of the sheet tray in the container body, the tray locking device regulating the movement of the tray handler from the first position to the second position and allowing the tray side stopper portion to move from the engaged position to the separated position without moving the tray handler.

2. The sheet conveying device according to claim 1, wherein the tray handler includes a handle mounted on the sheet tray to grasp when the sheet tray is removed from the container body.

3. The sheet container according to claim 1, wherein the tray locking device includes a cylinder lock and a regulating unit to regulate the movement of the tray handler from the first position to the second position, and wherein the cylinder lock turns to move the regulating unit between a regulating position at which the movement of the tray handler is regulated and a retreating position at which the regulating unit is retreated from the tray handler.

4. The sheet container according to claim 3, wherein the tray handler includes a guide to guide the regulating unit to the regulating position.

5. The sheet container according to claim 3, further comprising a pressing unit disposed near the tray handler to contact and regulate the tray handler to move to the second position when the regulating unit is located at the regulating position, wherein the pressing unit presses a face of the regulating unit opposite a contact face with the tray handler and prevents the regulating unit from bending toward the second position.

6. The sheet container according to claim 5, wherein the pressing unit includes a guide to guide the regulating unit to the regulating position.

7. The sheet container according to claim 1, further comprising a biasing unit to bias the tray handler in a direction opposite a moving direction of the tray handler toward the second position.

8. The sheet container according to claim 1, further comprising a biasing unit to bias the tray side stopper device such that the tray side stopper portion is located at the engaged position.

9. The sheet container according to claim 1, further comprising a stopper guide to guide the tray side stopper portion such that the tray side stopper portion rides over the body side stopper device when the sheet tray is inserted to the container body.

10. An image forming apparatus comprising the sheet container according to claim 1 to accommodate a sheet; and an image forming device to form an image on the sheet fed from the sheet container.

* * * * *